US010034345B1

(12) United States Patent
Matsubayashi et al.

(10) Patent No.: US 10,034,345 B1
(45) Date of Patent: Jul. 24, 2018

(54) LIGHTING APPARATUS

(71) Applicant: PANASONIC INTELLECTUAL PROPERTY MANAGEMENT CO., LTD., Osaka (JP)

(72) Inventors: Yoko Matsubayashi, Osaka (JP); Kazuki Harada, Osaka (JP); Youji Tachino, Nara (JP); Makoto Yamada, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 15/873,398

(22) Filed: Jan. 17, 2018

(30) Foreign Application Priority Data

Jan. 25, 2017 (JP) ..... 2017-011477

(51) Int. Cl.

| | |
|---|---|
| ***H05B 37/00*** | (2006.01) |
| ***H05B 33/08*** | (2006.01) |
| *F21K 9/66* | (2016.01) |
| *F21Y 115/10* | (2016.01) |
| *F21Y 113/13* | (2016.01) |
| *F21Y 105/18* | (2016.01) |

(52) U.S. Cl.
CPC ..... *H05B 33/0863* (2013.01); *F21K 9/66* (2016.08); *F21Y 2105/18* (2016.08); *F21Y 2113/13* (2016.08); *F21Y 2115/10* (2016.08)

(58) Field of Classification Search
CPC .. H05B 41/28; H05B 41/295; H05B 41/2827; H05B 41/3925; H05B 33/0815; H05B 33/0818; H05B 41/2828; H05B 41/3921; H05B 41/3927; H05B 37/029; H05B 33/0803; H05B 37/0254; H05B 37/02; H05B 33/0821; H05B 33/0827; Y02B 20/202; F21S 4/001; B23K 11/248; B60L 1/14; B61L 5/1881; F21V 23/04; G05F 1/14
See application file for complete search history.

(56) References Cited

U.S. PATENT DOCUMENTS

| | | | | |
|---|---|---|---|---|
| 5,770,917 | A | 6/1998 | Yano et al. | |
| 2011/0309754 | A1* | 12/2011 | Ashdown ..... | H05B 33/0818 315/151 |
| 2012/0056545 | A1* | 3/2012 | Radermacher ..... | H05B 33/0818 315/152 |

FOREIGN PATENT DOCUMENTS

| | | | |
|---|---|---|---|
| JP | 04-137305 | A | 5/1992 |
| JP | 09-120797 | A | 5/1997 |
| JP | 2003-237464 | A | 8/2003 |
| JP | 2005-302500 | A | 10/2005 |

(Continued)

*Primary Examiner* — Minh D A
(74) *Attorney, Agent, or Firm* — Greenblum & Bernstein, P.L.C.

(57) ABSTRACT

A lighting apparatus includes: first light emitting elements; second light emitting elements having chromaticity values in a same chromaticity range as the first light emitting elements; and a control circuit including a mode switch for controlling the first light emitting elements and the second light emitting elements separately. The control circuit selectively executes a first mode which causes the first light emitting elements to emit light and a second mode which causes the first light emitting elements and the second light emitting elements to emit light. The mode switch switches between the first mode and the second mode.

11 Claims, 11 Drawing Sheets

(56) References Cited

FOREIGN PATENT DOCUMENTS

| | | | |
|---|---|---|---|
| JP | 2014-75186 | A | 4/2014 |
| JP | 2015-022944 | A | 2/2015 |

* cited by examiner

FIG. 7

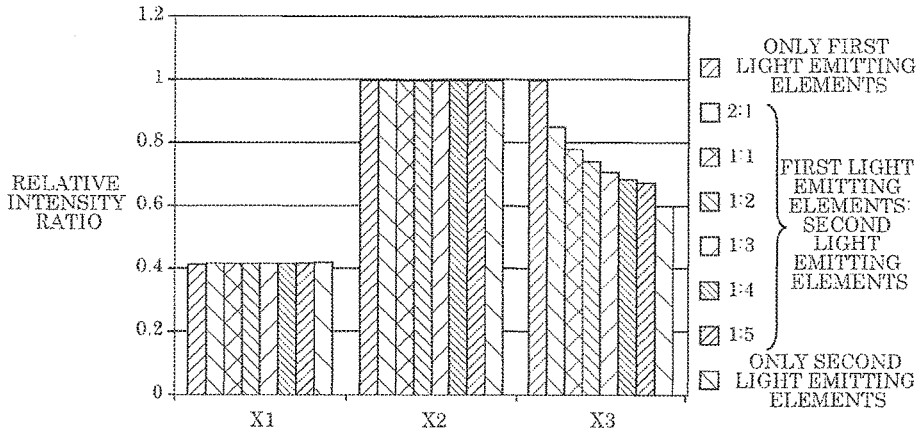

FIG. 8

| | CORRELATED COLOR TEMPERATURE [K] | Duv | Ra | FCI | WHITISHNESS (CHROMA VALUE) |
|---|---|---|---|---|---|
| FIRST LIGHT EMITTING ELEMENTS | 6303 | 6.0 | 82 | 89 | 3.1 |
| SECOND LIGHT EMITTING ELEMENTS | 6536 | -0.3 | 94 | 109 | 2.0 |
| THIRD LIGHT EMITTING ELEMENTS | 2664 | -0.1 | 83 | 110 | 11.5 |
| FIRST LIGHT EMITTING ELEMENTS + THIRD LIGHT EMITTING ELEMENTS | 6245 | 5.7 | 82 | 90 | 2.9 |
| (FIRST LIGHT EMITTING ELEMENTS: SECOND LIGHT EMITTING ELEMENTS = 1:1) + THIRD LIGHT EMITTING ELEMENTS | 6202 | 2.5 | 90 | 99 | 1.5 |
| (FIRST LIGHT EMITTING ELEMENTS: SECOND LIGHT EMITTING ELEMENTS = 1:2) + THIRD LIGHT EMITTING ELEMENTS | 6238 | 1.4 | 94 | 103 | 0.9 |
| (FIRST LIGHT EMITTING ELEMENTS: SECOND LIGHT EMITTING ELEMENTS = 1:3) + THIRD LIGHT EMITTING ELEMENTS | 6255 | 0.9 | 95 | 104 | 0.6 |
| (FIRST LIGHT EMITTING ELEMENTS: SECOND LIGHT EMITTING ELEMENTS = 1:4) + THIRD LIGHT EMITTING ELEMENTS | 6268 | 0.5 | 95 | 105 | 0.7 |
| (FIRST LIGHT EMITTING ELEMENTS: SECOND LIGHT EMITTING ELEMENTS = 1:5) + THIRD LIGHT EMITTING ELEMENTS | 6276 | 0.3 | 95 | 106 | 0.8 |
| SECOND LIGHT EMITTING ELEMENTS + THIRD LIGHT EMITTING ELEMENTS | 6322 | -1.0 | 94 | 110 | 1.5 |

FIG. 10
(a)
| | CORRELATED COLOR TEMPERATURE [K] | Duv | Ra | FCI | WHITISHNESS (CHROMA VALUE) | EFFICIENCY PERCENTAGE [%] |
|---|---|---|---|---|---|---|
| TEST 1 | 5003 | -2.2 | 85 | 100 | 3.8 | — |
| TEST 2 | 6220 | 2.1 | 83 | 92 | 1.7 | 100 |
| TEST 3 | 6177 | 0.7 | 92 | 104 | 0.2 | 83 |
(b)
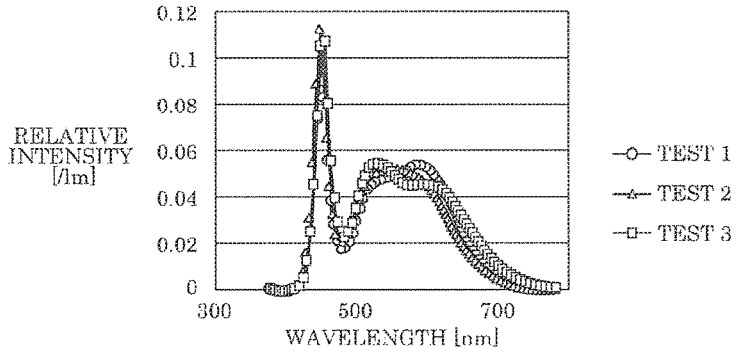
(c)
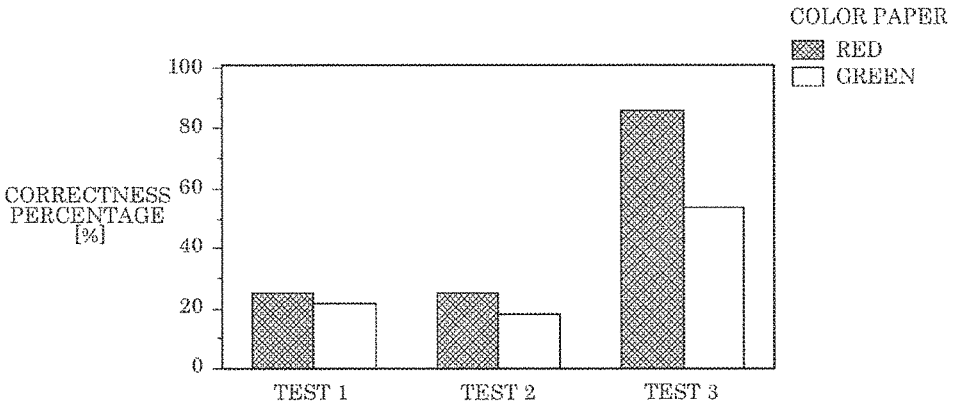

FIG. 16
(a)
| | CORRELATED COLOR TEMPERATURE [K] | Duv | Ra | FCI | WHITISHNESS (CHROMA VALUE) | DESK TOP SURFACE ILLUMINANCE [lx] |
|---|---|---|---|---|---|---|
| FIRST MODE | 4995 | 2.9 | 81 | 95 | 4.1 | 575 |
| SECOND MODE | 6166 | 1.0 | 92 | 103 | 1.3 | 808 |
(b)
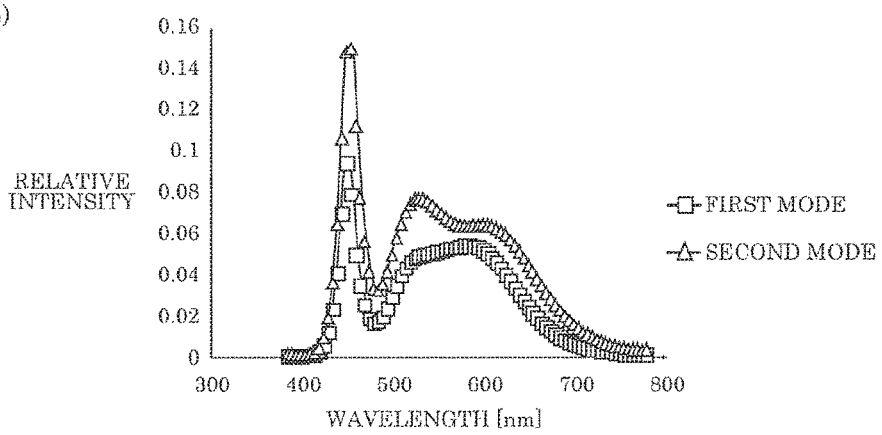
(c)
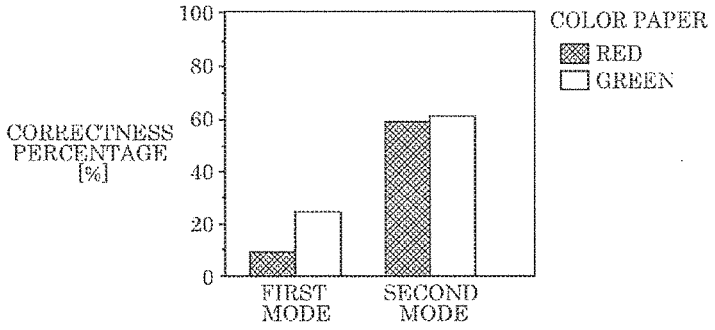

FIG. 17
(a)
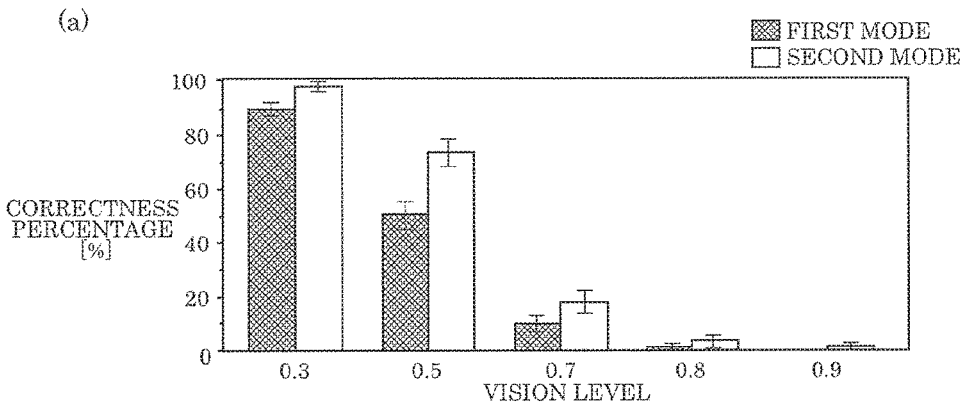
(b)
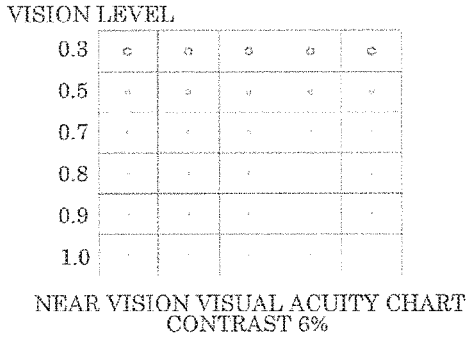
(c)
CORRECTNESS PERCENTAGE [%] = NUMBER OF CORRECT ANSWERS / 5 × 100

LIGHTING APPARATUS

CROSS REFERENCE TO RELATED APPLICATION

This application claims the benefit of priority of Japanese Patent Application Number 2017-011477 filed on Jan. 25, 2017, the entire content of which is hereby incorporated by reference.

BACKGROUND

1. Technical Field

The present disclosure relates to a lighting apparatus, and in particular to a lighting apparatus for correcting a change in visual performance due to aging.

2. Description of the Related Art

With the arrival of an aging society, there has been a great demand for a comfortable environment for old aged people (middle aged generation and over). In particular, improvement of visual environment achieved by lighting is an urgent issue. As such, it is thus necessary to clarify how lighting can correct a change in human visual system caused by aging. Examples of a change in visual performance due to aging mainly include (a) a fall in transmittance of a crystalline lens, in particular a fall in transmittance of a crystalline lens in a short wavelength range, and (b) a bleary eye (intraocular scattering) due to a cataract (a crystalline lens clouding over).

In order to address (a), lighting which increases a proportion of blue light that reaches a retina by intensifying light in a wavelength range where a transmittance of a crystalline lens falls, or in other words, by causing light to have a so-called high color temperature is recommended for old aged people, as disclosed in Japanese Unexamined Patent Application Publication No. 2003-237464.

Furthermore, there is a method of intensifying blue light components in order to take also (b) into consideration, as disclosed in Japanese Unexamined Patent Application Publication No. H04-137305. Japanese Unexamined Patent Application Publication No. H04-137305 recommends lighting which reduces glare by mainly reducing light in a wavelength range (of at least 470 nm and at most 530 nm) which has strong influence on glare, and thus yields advantageous effects of allowing users to perceive high contrast, high luminosity, and high color saturation.

Taking (b) into consideration, there is also a method of adjusting a color-variable wall in order to reduce intraocular scattering due to ambient light, as disclosed in Japanese Unexamined Patent Application Publication No. 2005-302500.

SUMMARY

Here, since it is regarded that the brightness necessary for old aged people to perform visual tasks is 2 to 5 times that for younger people, there has been a demand for a lighting apparatus which allows old aged people to perceive highly vivid colors while avoiding glare.

In view of this, the present disclosure provides a lighting apparatus which prevents letters and observed objects from appearing to have lower readability and color saturation to old aged people.

A lighting apparatus according to an aspect of the present disclosure includes: first light emitting elements; second light emitting elements having chromaticity values in a same chromaticity range as the first light emitting elements; and a control circuit including a mode switch for controlling the first light emitting elements and the second light emitting elements separately. The first light emitting elements emit light having a spectral distribution that includes a first peak wavelength in a range of 425 nm to 480 nm inclusive and a second peak wavelength in a range of 500 nm to 560 nm inclusive. The second light emitting elements emit light having a spectral distribution that includes a first peak wavelength in a range of 425 nm to 480 nm inclusive, a second peak wavelength in a range of 500 nm to 560 nm inclusive, and a third peak wavelength in a range of 580 nm to 650 nm inclusive. In a spectral distribution of combined light which is a combination of the light emitted by the first light emitting elements and the light emitted by the second light emitting elements, a ratio of a greatest value in a range of 500 nm to 560 nm inclusive to a smallest value in a range of 500 nm to 650 nm inclusive is 0.85 or lower. The control circuit selectively executes a first mode for causing the first light emitting elements to emit light and a second mode for causing the first light emitting elements and the second light emitting elements to emit light. The mode switch switches between the first mode and the second mode.

According to the present disclosure, letters and observed objects are prevented from appearing to have lower readability and color saturation to old aged people.

BRIEF DESCRIPTION OF DRAWINGS

The figures depict one or more implementations in accordance with the present teaching, by way of examples only, not by way of limitations. In the figures, like reference numerals refer to the same or similar elements.

FIG. 7 is a graph illustrating relative intensity ratios at a first value and a third value of spectral distributions of light emitted by the light emitting elements having the ratios in number according to the embodiment, when the relative intensities at a second value are 1;

FIG. 8 is a table illustrating optical characteristics of the entire lighting apparatus at the ratios in number of the first light emitting elements to the second light emitting elements to the third light emitting elements according to the embodiment;

FIG. 10 is an explanatory diagram illustrating optical characteristics in tests 1 to 3 in a verification experiment, spectral distributions of combined light of tests 1 to 3, and correctness percentages of subjects for the spectral distributions used in tests 1 to 3;

FIG. 16 is an explanatory diagram illustrating optical characteristics in a first mode and a second mode in a verification experiment, spectral distributions of combined light in the first mode and the second mode, and correctness percentages of subjects for the spectral distributions in the first mode and the second mode; and FIG. 17 is an explanatory diagram illustrating correctness percentages for a first mode and a second mode at near vision level 0.5 in a near vision chart, obtained by verification experiment, a near vision chart (contrast 6%) used in the verification experiment, and a formula for calculating the correctness percentage at each vision level.

DETAILED DESCRIPTION OF THE EMBODIMENT

Figure 1:
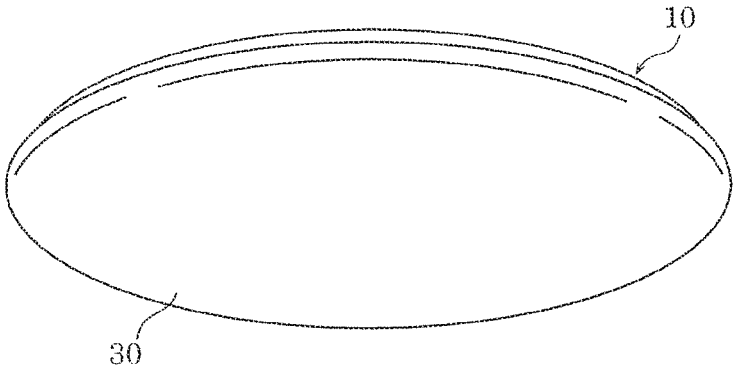
FIG. 1 is a perspective view of a lighting apparatus according to an embodiment.

Hereinafter, exemplary embodiments of the present disclosure will be described with reference to the drawings. The embodiments described below each show a specific example of the present disclosure. Therefore, numerical values, shapes, materials, elements, the arrangement and connection of the elements, and others indicated in the following embodiments are mere examples, and therefore are not intended to limit the present disclosure. Furthermore, among the structural components in the following embodiments, components not recited in any one of the independent claims which indicate the broadest concepts of the present invention are described as arbitrary structural components.

It should be noted that the drawings are schematic diagrams, and do not necessarily provide strictly accurate illustration. Furthermore, in the drawings, substantially identical components are assigned the same reference signs, and overlapping description is omitted or simplified.

The following describes a lighting apparatus according to exemplary embodiments of the present disclosure.

EMBODIMENT

[Configuration]

First, the configuration of lighting apparatus 10 according to this embodiment will be described using FIG. 1 and FIG. 2.

FIG. 1 is a perspective view of lighting apparatus 10 according to this embodiment. FIG. 2 is an exploded perspective view of lighting apparatus 10 according to this embodiment.

Figure 2:
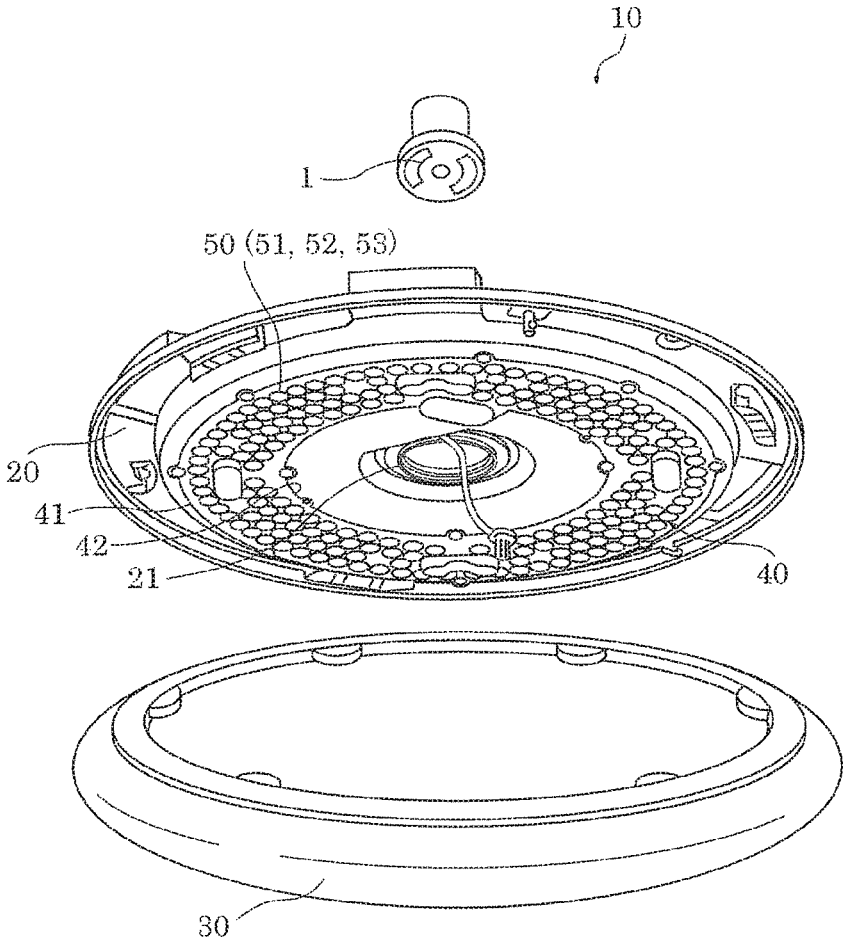
FIG. 2 is an exploded perspective view of the lighting apparatus according to the embodiment.

As illustrated in FIG. 1 and FIG. 2, lighting apparatus 10 includes device body 20, cover 30, and light emitter 40. Lighting apparatus 10 is detachably attached to, for example, hook ceiling body 1 provided in the ceiling of a building such as a house, for example.

Device body 20 is a casing for supporting cover 30 and light emitter 40. Device body 20 is formed in a ring shape having circular opening 21 in the center portion. Hook ceiling body 1 is connected to light emitter 40 via opening 21.

It should be noted that device body 20 is formed in the stated shape by performing press working on sheet metal such as an aluminum plate or a steel plate, for example. In order to increase reflectivity to improve light extraction efficiency, white coating is applied onto or a reflective metal material is vapor-deposited onto an inner surface (floor-side surface) of device body 20.

Cover 30 is an external cover for covering the entire inner surface of device body 20, and is detachably attached to device body 20. Accordingly, light emitter 40 is disposed inside cover 30. Cover 30 is formed in a circular dome shape. Cover 30 is formed of a light-transmissive resin material such as, for example, acrylics (PMMA), polycarbonate (PC), polyethylene terephthalate (PET), or polyvinyl chloride (PVC). Accordingly, light emitted by light emitter 40 toward the inner surface of cover 30 passes and exits through cover 30. It should be noted that cover 30 may be provided with a light-diffusing property by forming cover 30 using a milk-white resin material.

Light emitter 40 is a light source for emitting white light, for example. Specifically, light emitter 40 includes substrate 41 and light emitting elements 50 mounted on a mounting surface (floor-side surface) of substrate 41.

Substrate 41 is a printed-circuit board for mounting light emitting elements 50, and is formed in a ring shape having circular opening 42 in the center portion. A wiring pattern (not illustrated) for mounting light emitting elements 50 is formed on substrate 41. The wiring pattern is for supplying direct current from a circuit portion (including constant-power output circuit 11 and control circuit 12: see FIG. 5) to light emitting elements 50, by electrically connecting light emitting elements 50 to the circuit portion.

Light emitting elements 50 are disposed on substrate 41 in multiple rings. Light emitting elements 50 are, for example, packaged surface-mount device (SMD)-type white LED elements. It should be noted that a chip on board (COB)-type module in which an LED chip is mounted directly on substrate 41 may be used.

Light emitting elements 50 include first light emitting elements 51, second light emitting elements 52, and third light emitting elements 53.

First light emitting elements 51 and second light emitting elements 52 have chromaticity values in the same chromaticity range. Here, the "same chromaticity range" is a range for one of light source colors (daylight color, day white color, white color, warm white color, and electric lamp color) standardized in JIS Z9112-2012 "Classification of fluorescent lamps and light emitting diodes by chromaticity and colour rendering property". For example, if first light emitting elements 51 have chromaticity values that fall within the chromaticity range for daylight color, second light emitting elements 52 also have chromaticity values that fall within the chromaticity range for daylight color.

The correlated color temperature of the combined light of first light emitting elements 51 and second light emitting elements 52 is at least 5500 K and at most 7100 K. In particular, the correlated color temperature of the combined light of first light emitting elements 51 and second light emitting elements 52 is preferably at least 5800 K.

The correlated color temperature of third light emitting elements 53 is at least 2600 K and at most 5500 K. Third light emitting elements 53 have a color temperature lower than the respective color temperatures of first light emitting elements 51 and second light emitting elements 52.

Next, the spectral distributions of first light emitting elements 51 and second light emitting elements 52 will be described using FIG. 3.

Figure 3:
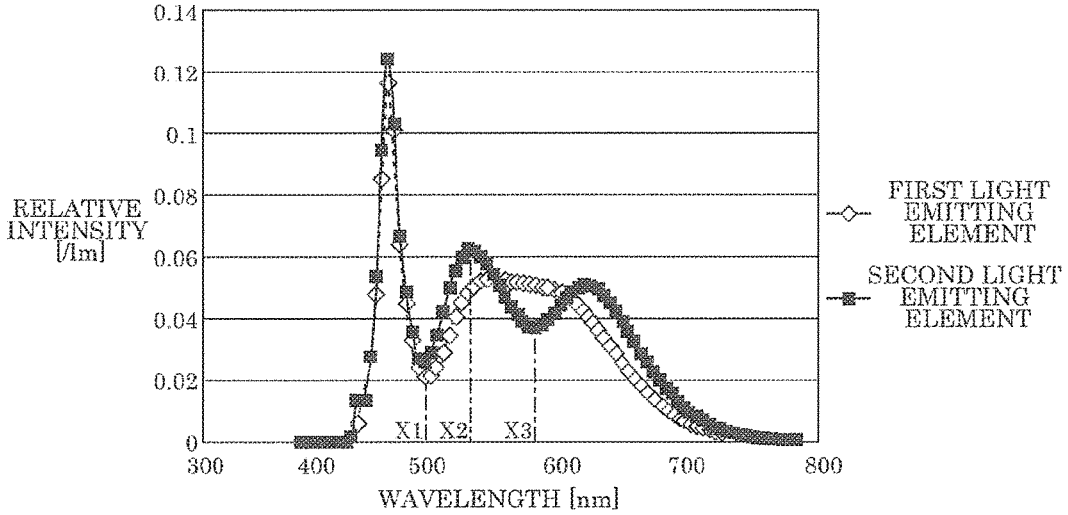
FIG. 3 is a graph illustrating examples of spectral distributions of first light emitting elements and second light emitting elements according to the embodiment.

FIG. 3 is a graph illustrating examples of spectral distributions of first light emitting elements 51 and second light emitting elements 52 according to this embodiment.

As illustrated in FIG. 3, first light emitting elements 51 have a spectral distribution with a first peak wavelength in a range of 425 nm to 480 nm inclusive, and a second peak wavelength in a range of 500 nm to 560 nm inclusive. Second light emitting elements 52 have a spectral distribution with a first peak wavelength in a range of 425 nm to 480 nm inclusive, a second peak wavelength in a range of 500 nm to 560 nm inclusive, and a third peak wavelength in a range of 580 nm to 650 nm inclusive.

Comparison between first light emitting elements 51 and second light emitting element 52 shows that the spectral distribution of first light emitting elements 51 has a higher priority to light emission efficiency than that of second light emitting elements 52. In contrast, the spectral distribution of second light emitting elements 52 has a higher priority to a color rendering property than that of first light emitting elements 51.

Here, in FIG. 3, a local maximum at the second peak wavelength of the spectral distribution of second light emitting elements 52 is second value X2, a local minimum on the negative side relative to second value X2 is first value X1, and a local minimum on the positive side relative to second value X2 is third value X3. In the example in FIG. 3, first value X1 is 480 nm, second value X2 is 520 nm, and third value X3 is 570 nm.

Next, the arrangement of first light emitting elements 51, second light emitting elements 52, and third light emitting elements 53 will be described using FIG. 4. It should be noted that the layout of first light emitting elements 51, second light emitting elements 52, and third light emitting elements 53 may be arbitrarily changed, and is not limited to the layout in FIG. 4.

Figure 4:
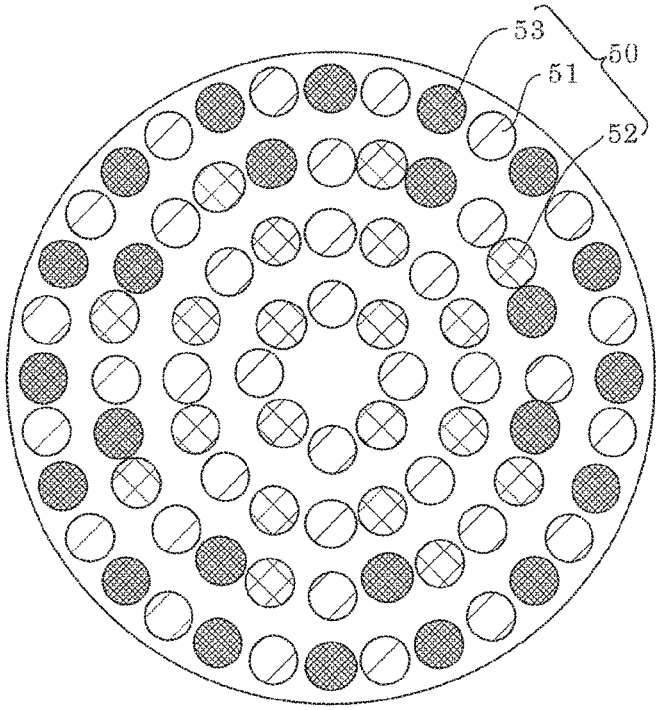
FIG. 4 is a schematic diagram illustrating an example of arrangement of the first light emitting elements, the second light emitting elements, and third light emitting elements according to the embodiment.

FIG. 4 is a schematic diagram illustrating an example of the arrangement of first light emitting elements 51, second light emitting elements 52, and third light emitting elements 53 according to this embodiment. Accordingly, since FIG. 4 is a schematic diagram, it does not necessarily conform to FIG. 2.

As illustrated in FIG. 4, light emitting elements 50 are arranged on substrate 41 in four rings. Here, the innermost ring is formed by 4 first light emitting elements 51 and 4 second light emitting elements 52 which are arranged at regular intervals along the circumference. The first middle ring adjacent to the innermost ring is formed by 8 first light emitting elements 51 and 8 second light emitting elements 52 which are arranged at regular intervals along the circumference. The second middle ring adjacent to the first middle ring is formed by 8 first light emitting elements 51, 8 second light emitting elements 52, and 8 third light emitting elements 53 which are arranged at regular intervals along the circumference. The outermost ring is formed by 16 first light emitting elements 51 and 16 third light emitting elements 53 which are arranged at regular intervals along the circumference.

Next, the configuration of lighting apparatus 10 will be described using FIG. 5.

Figure 5:
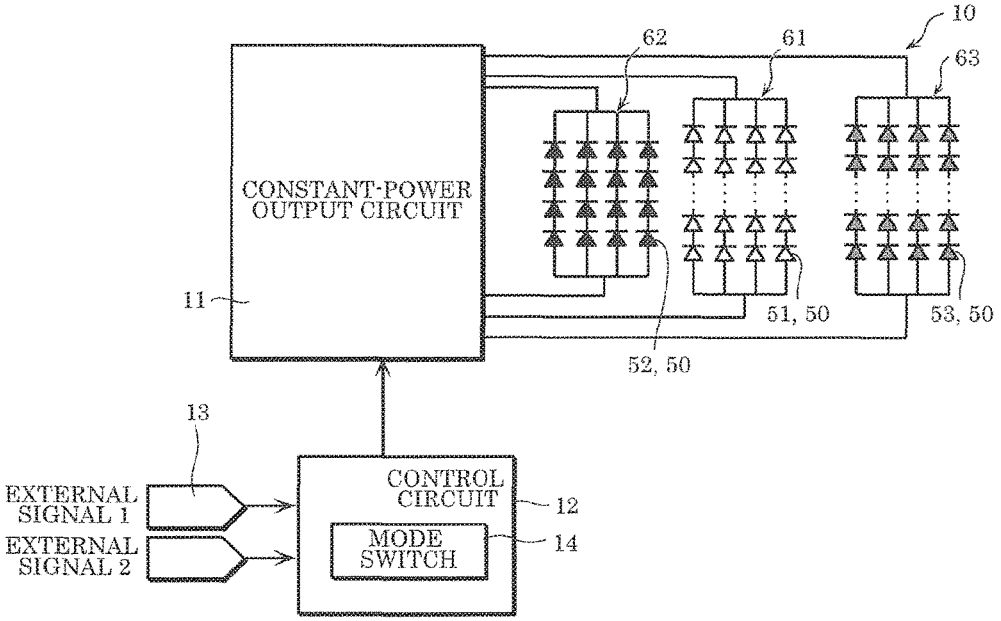
FIG. 5 is a block diagram illustrating the lighting apparatus according to the embodiment.

FIG. 5 is a block diagram illustrating lighting apparatus 10 according to this embodiment.

As illustrated in FIG. 5, lighting apparatus 10 includes constant-power output circuit 11 and control circuit 12.

Constant-power output circuit 11 is a circuit for supplying constant power to light emitting elements 50.

Control circuit 12 controls constant-power output circuit 11 when an external signal (external signal 1 described later) for lighting is input by, for example, a light-on switch which is not illustrated being turned on, and causes light emitting elements 50 to emit light.

Two external signals are input to control circuit 12. One of the external signals (external signal 1) is a signal for lighting and the other external signal (external signal 2) is a signal including information indicating the age or generation of viewers. When an input of an age or generation is input from a user to setter 13 which inputs (sets) the other external signal to control circuit 12, setter 13 generates an external signal including information indicating the age or generation and inputs this external signal to control circuit 12.

Control circuit 12 includes mode switch 14 capable of controlling first light emitting elements 51 and second light emitting elements 52 separately. It should be noted that although mode switch 14 is provided inside control circuit 12 in this embodiment, mode switch 14 may be a separate body from control circuit 12.

Control circuit 12 performs control to increase the amount of light emitted by second light emitting elements 52 in proportion to the age or generation of the user that is set by setter 13. Specifically, when mode switch 14 receives, for example, a signal including information indicating the age or generation of a user from setter 13, mode switch 14 switches between a first mode and a second mode to be described later, according to the age or generation of the user. Control circuit 12 selectively executes the first mode which causes first light emitting elements 51 to emit light and the second mode which causes first light emitting elements 51 and second light emitting elements 52 to emit light. The first mode and the second mode are generically referred to as modes.

The first mode is a mode for executing normal lighting performed by typical illumination. The second mode is a mode that executes lighting capable of increasing the color perception percentage for old aged people, and faithfully reproduces a color while improving readability of letters compared to the first mode. Control circuit 12 causes brighter light emission when causing light emission in the second mode than when causing light emission in the first mode. Here, brightness is not limited to illuminance, and also means luminous flux.

When mode switch 14 switches to the first mode, control circuit 12 causes mainly first light emitting elements 51 to emit light. Furthermore, when mode switch 14 switches to the second mode, control circuit 12 causes at least first light emitting elements 51 and second light emitting elements 52 to emit light. However, control circuit 12 performs control to cause brighter light emission when causing second light emitting elements 52 and third light emitting elements 53 to emit light in the second mode than when causing second light emitting elements 52 and third light emitting elements 53 to emit light in the first mode.

It should be noted that, in the first mode, it is sufficient that either only first light emitting elements 51 or only third light emitting elements 53 emit light.

Light emitting elements 50 are divided into a plurality of groups, and the groups of light emitting elements 50 are electrically connected to constant-power output circuit 11 using mutually different routes. Specifically, a total of four groups each including first light emitting elements 51 are provided, a total of four groups each including second light emitting elements 52 are provided, and a total of four groups each including third light emitting elements 53 are provided. In addition, first light emitting elements 51, second light emitting elements 52, and third light emitting elements 53 in each group are electrically connected in series. In addition, first light emitting elements 51, second light emitting elements 52, and third light emitting elements 53 are divided into 3 modules each having four groups. First light emitting module 61 includes first light emitting elements 51, second light emitting module 62 includes second light emitting elements 52, and third light emitting module 63 includes third light emitting elements 53. First light emitting module 61, second light emitting module 62, and third light emitting module 63 are electrically connected to constant-power output circuit 11 using mutually different routes.

Accordingly, control circuit 12 controls first light emitting elements 51, second light emitting elements 52, and third light emitting elements 53 using current having different values, by controlling constant-power output circuit 11. Therefore, the light color of entire lighting apparatus 10 is adjusted.

It should be noted that when the light color of entire lighting apparatus 10 is not to be adjusted, first light emitting elements 51, second light emitting elements 52, and third light emitting elements 53 may be disposed in the same circuit and controlled using current having the same value.

[Combined Light]

The following describes combined light which is a combination of light emitted by first light emitting elements 51 and second light emitting elements 52.

Figure 6:
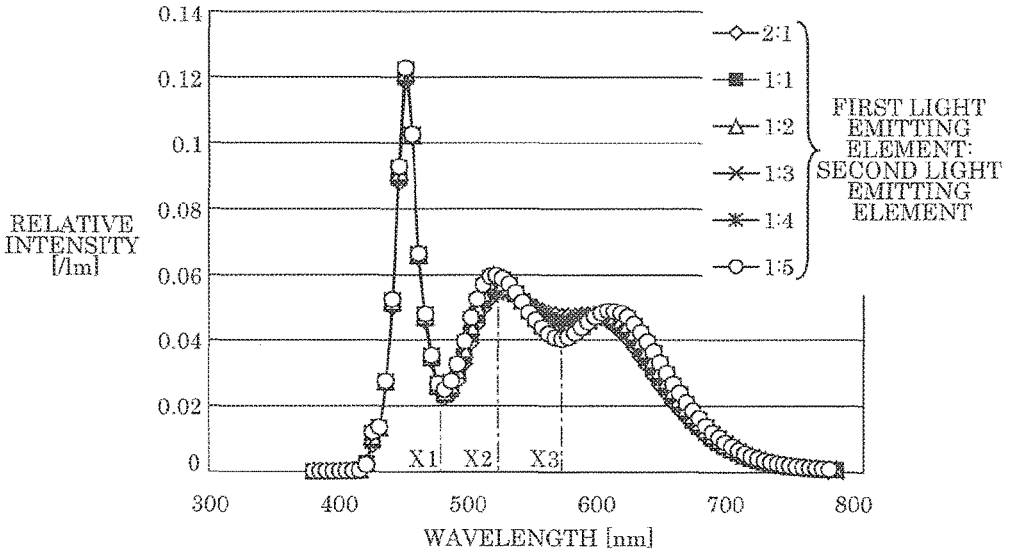
FIG. 6 is a graph illustrating, when the ratio in number of the first light emitting elements to the second light emitting elements according to the embodiment is changed, spectral distributions of combined light at the ratios in number.

FIG. 6 is a graph illustrating, when the ratio in number of first light emitting elements 51 to second light emitting elements 52 according to this embodiment is changed, spectral distributions of combined light at the ratios in number. FIG. 6 illustrates the spectral distributions (relations between wavelength and relative intensity) of combined light at the ratios in number, in the second mode.

FIG. 6 illustrates spectral distributions of combined light when the ratio in number of first light emitting elements 51 to second light emitting elements 52 is 2:1, 1:1, 1:2, 1:3, 1:4, and 1:5.

Next, based on the results, proportions of relative intensities (relative intensity ratios) at first value X1 and third value X3 of spectral distributions of light emitted by the light emitting elements having the ratios in number were calculated, when the relative intensities at second value X2 were assumed to be 1.

FIG. 7 is a graph illustrating changes of relative intensity ratios at first value X1 and third value X3 of spectral distributions of light emitted by the light emitting elements having the ratios in number according to this embodiment, when the relative intensities at second value X2 are 1.

As illustrated in FIG. 7, the relative intensity ratios at first value X1 do not show significant changes at any spectral distributions, yet the relative intensity ratios at third value X3 decrease with an increase in the proportion of second light emitting elements 52.

Furthermore, it can be seen that if the percentage of second light emitting elements 52 among first light emitting elements 51 and second light emitting elements 52 satisfies at least a 2:1 ratio in number of first light emitting elements 51 to second light emitting elements 52, the relative intensity ratios of light having third value X3 when the relative intensity at second value X2 is 1 is 0.85 or lower in either case. Specifically, regarding a spectral distribution of combined light which is a combination of the light emitted by first light emitting elements 51 and the light emitted by second light emitting elements 52, if a ratio of the greatest value (relative intensity at second value X2) in a range of 500 nm to 560 nm inclusive to the smallest value (relative intensity at third value X3) in the range of 500 nm to 650 nm inclusive is 0.85 or lower, color perception percentage for old aged people can be secured to a certain degree.

FIG. 8 is a table illustrating optical characteristics of entire lighting apparatus 10 at the ratios in number of first light emitting elements 51 to second light emitting elements 52 to third light emitting elements 53 according to this embodiment.

As illustrated in FIG. 8, the optical characteristics of entire lighting apparatus 10 are optical characteristics of combined light which is a combination of light emitted by first light emitting elements 51, light emitted by second light emitting elements 52, and light emitted by third light emitting elements 53. As is clear from FIG. 8, excluding third light emitting elements 53, at all the ratios in number, the correlated color temperatures of the combined light of first light emitting elements 51 and second light emitting elements 52 are at least 5500 K and at most 7100 K. Furthermore, the correlated color temperature of third light emitting elements 53 is at least 2600 K and at most 5500 K.

Here, a feeling of contrast index (FCI) is a so called index for distinctness and is proposed in, for example, Japanese Unexamined Patent Application Publication No. H09-120797. Specifically, FCI is a percentage of brightness perceived under standard light D65, based on color appearance. As is clear from FIG. 8, at all the ratios in number, the index for distinctness FCI of light emitted by lighting apparatus 10 in the second mode is at least 93 and at most 120. In particular, in the second mode, since FCI is 99 when the ratio in number of first light emitting elements 51 and second light emitting elements 52 is 1:1, FCI is preferably 99 or more. Since there is a report that discomfort is imparted when FCI exceeds 120, an upper limit is provided for the FCI.

The general color rendering index Ra of light emitted by lighting apparatus 10 in the second mode is at least 86 and at most 100. The general color rendering index Ra is an index for evaluating faithful reproduction of color, and a guide for the indexes is indicated in JIS Z9112 "Classification of fluorescent lamps by chromaticity and colour rendering property". More specifically, in the second mode, the general color rendering index Ra is preferably 90 or more. As is clear from FIG. 8, in the second mode, at all the ratios in number, the general color rendering index Ra is at least 86 and at most 100.

For the light emitted by lighting apparatus 10 in the second mode, a chroma value calculated using the CIE 1997 Interim Color Appearance Model (Simple Version) being 2.0 or less. The chroma value is an index for quantitatively evaluating whitishness of an object to be viewed. Chromaticness is high when the chroma value is large, whereas chromaticness is low when the chroma value is small. Chroma value is an index disclosed in, for example, Japanese Unexamined Patent Application Publication No. 2014-

75186. Accordingly, when the chroma value is small, whitishness is high. As is clear from FIG. 8, in the second mode, at all the ratios in number, the chroma value is 2.0 or less.

Figure 9:
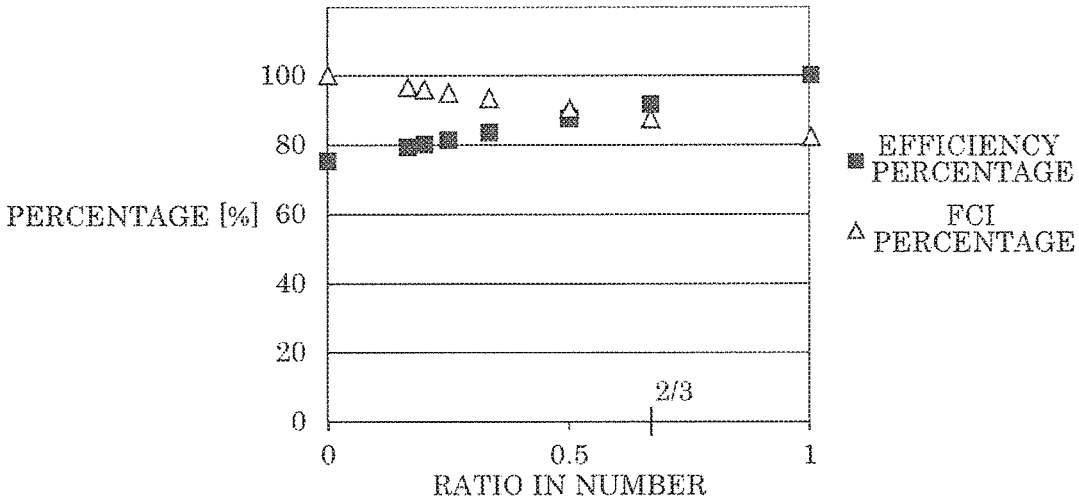
FIG. 9 is a graph illustrating a relation between ratio in number of the first light emitting elements to the second light emitting elements and an efficiency percentage and a FCI percentage in FIG. 8.

FIG. 9 is a graph illustrating a relation between ratio in number of first light emitting elements 51 to second light emitting elements 52 and an efficiency percentage and a PCI percentage in FIG. 8.

Here, when light emission efficiency achieved when only first light emitting elements 51 are used is 100%, the efficiency percentages are relatively calculated from light emission efficiency in other cases. When FCI achieved when only second light emitting elements 52 are used is 100%, the FCI percentages are relatively calculated from FCIs in other cases.

Here, the proportion in number is the proportion of the number of first light emitting elements 51 disposed to the number of all light emitting elements 50 disposed. In FIG. 9, for example, looking in order from when the proportion in number is "0", a proportion in number of "0" is the case where only second light emitting elements 52 are included, efficiency percentage is 75% and FCI percentage is 100%. Next, when the ratio in number is 1:5, the proportion in number is "0.17", efficiency percentage is 79%, and FCI percentage is 97%. Next, when the ratio in number is 1:4, the proportion in number is "0.20", efficiency percentage is 80%, and FCI percentage is 96%. Next, when the ratio in number is 1:3, the proportion in number is "0.25", efficiency percentage is 81%, and FCI percentage is 95%. Next, when the ratio in number is 1:2, the proportion in number is "0.33", efficiency percentage is 83%, and FCI percentage is 93%. Next, when the ratio in number is 1:1, the proportion in number is "0.5", efficiency percentage is 88%, and FCI percentage is 90%. Next, when the ratio in number is 2:1, the proportion in number is "0.67", efficiency percentage is 92%, and FCI percentage is 90%. A proportion in number of "1" is the case where only first light emitting elements 51 are included, efficiency percentage is 100% and FCI percentage is 82%.

[Verification Experiment]

The inventors examined, by the experiment, how FCI percentages influence how colors appear to viewers.

Part (a) in FIG. 10 is a table illustrating optical characteristics in tests 1 to 3 in the verification experiment.

As indicated in (a) in FIG. 10, test 1 shows test results when a general purpose apparatus having a correlated color temperature of approximately 5000 K is used. Test 2 shows test results when a general purpose apparatus emitting light with a correlated color temperature of approximately 6200 K is used. Test 3 shows test results when an apparatus in which the ratio in number of first light emitting elements 51 to second light emitting elements 52 according to this embodiment is 1 to 2, and which emits light having a correlated color temperature of approximately 6200 K is used.

Part (b) in FIG. 10 is a graph illustrating spectral distributions of combined light of tests 1 to 3 in (a) in FIG. 10. Part (b) in FIG. 10 shows spectral distributions used in tests 1 to 3.

Part (c) in FIG. 10 is a graph illustrating correctness percentages of subjects for the spectral distributions used in tests 1 to 3. Part (c) in FIG. 10 illustrates the correctness percentages of subjects when lights having the respective correlated color temperatures in tests 1 to 3 are used.

The subjects consisted of 3 males and 4 females in the maturing age of 29 to 39 years old, 3 males and 4 females in the middle age of 45 to 64 years old, and 7 males and 7 females in the old age of 65 to 69 years old for a total of 28 persons. The average age for the maturing age is 34 years, the average age for the middle age is 54 years, and the average age for the old age is 67 years.

As illustrated in (c) in FIG. 10, in this verification experiment, the results for the correctness percentages for the three groups consisting of the maturing age group, the middle age group, and the old age group was obtained using red color paper and green color paper, with a chroma difference of 0.5 between the respective color papers. The results show that the correlated color temperature of test 3 had the highest correctness percentage. Furthermore, for the correlated color temperatures of tests 1 and 2, there was no significant difference in the correctness percentages when the color paper was red, whereas when the color paper was green, the correctness percentage was slightly higher for the correlated color temperature of test 1 than the correlated color temperature of test 2. The result obtained was that, for all the correlated color temperatures of tests 1 to 3, red color paper had a higher correctness percentage than green color paper. With the correlated color temperature in test 3, correctness percentages were extremely high when the color paper was red than when the color paper was green. Based on the above, the following results were obtained. Specifically, in tests 1 and 2, the correctness percentages were approximately 20% whether the color paper was red or green. In the second mode, however, the correctness percentage was over 80% with a red color paper, and the correctness percentage was over 50% with a green color paper.

From these results, it can be determined that in test 3, which is one example of this embodiment, correctness percentages significantly increased as a result of being able to see the color paper vividly. Among tests 1 to 3, only test 3 in (a) in FIG. 10 satisfies the condition in which FCI is 99 or higher and the chroma value is 2.0 or lower.

Furthermore, since the general color rendering index Ra of light emitted in test 1 is 85, the general color rendering index Ra of light emitted by lighting apparatus 10 in the second mode according to this embodiment is set to be from 86 to the upper limit of 100.

Furthermore, since the FCI of light emitted in test 2 is 92, the FCI of light emitted by lighting apparatus 10 in the second mode according to this embodiment is set to be at least 93 and at most 120.

Figure 11:
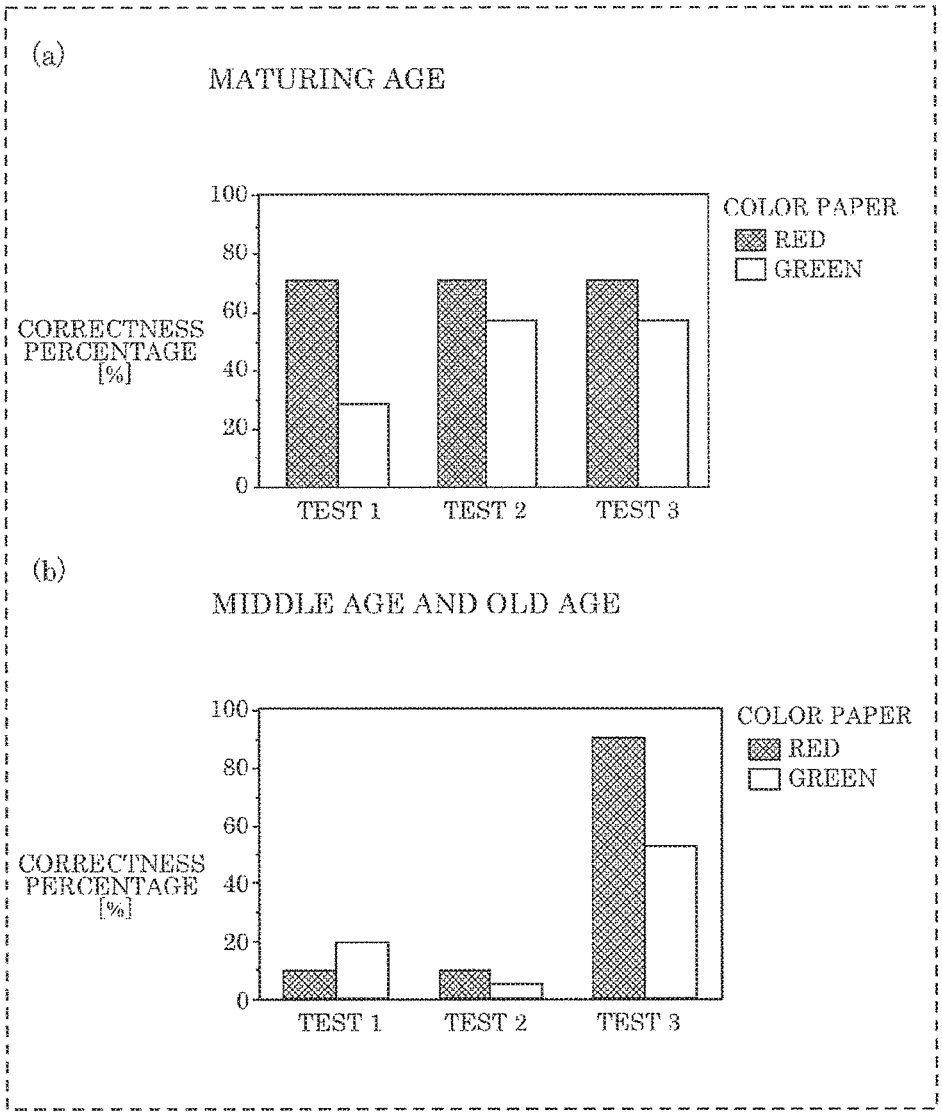
FIG. 11 is an explanatory diagram illustrating correctness percentages of middle aged subjects for the spectral distributions used in tests 1 to 3, and correctness percentages of middle aged and old aged subjects for the spectral distributions used in tests 1 to 3.

Next, the inventors examined contrast sensitivity of subjects in the maturing age, middle age, and old age to obtain correctness percentages of the subjects. In FIG. 11, verification examination under the same conditions as in FIG. 10 is performed, and thus detailed description of the same conditions will be omitted.

Part (a) in FIG. 11 is a graph illustrating correctness percentages of middle aged subjects for the spectral distributions used in tests 1 to 3. Part (a) in FIG. 11 illustrates the correctness percentages when lights having the same correlated color temperatures as in tests 1 to 3 in FIG. 10 are used and the subjects are in the middle age.

With the middle aged subjects, for the red color paper, no big difference in correctness percentage was observed for any of the correlated color temperatures. In contrast, for the green color paper, the correctness percentage decreased for the correlated color temperature in test 1, and the correctness percentages for the correlated color temperatures in tests 2 and 3 were close to twice the correctness percentage in test 1.

Part (b) in FIG. 11 is a graph illustrating correctness percentages of middle aged and old aged subjects for the spectral distributions used in tests 1 to 3. Part (b) in FIG. 11 illustrates the correctness percentages when lights having the respective correlated color temperatures in tests 1 to 3 in FIG. 10 are used and the subjects are in the middle age and old age. The number of middle aged and old aged people is 21 and the average age is 63 years.

With middle aged and old aged subjects, results were obtained in which correctness percentages were 20% or lower for red and green color paper for either one of the correlated color temperatures in tests 1 and 2.

In contrast, with the correlated color temperature in test 3, for rod color paper, a result of a correctness percentage of over 80% which is higher than those in tests 1 and 2, and exceeds the correctness percentage for maturing age subjects was obtained. Furthermore, with the correlated color temperature in test 3, for green color paper, a result of a correctness percentage of over 50% which is higher than those in tests 1 and 2, and is the same as the correctness percentage for maturing age subjects was obtained.

From the above, it can be seen that in test 3, which is one example of this embodiment, the correctness percentage increased as a result of the middle aged and old aged subjects being able to see the colored paper vividly.

Figure 12:
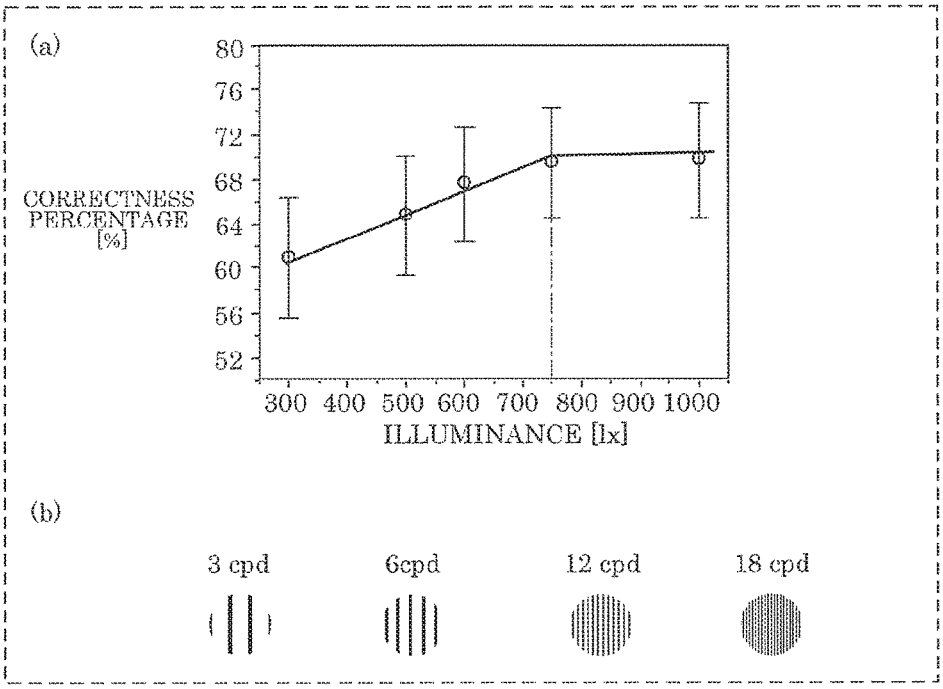
FIG. 12 is an explanatory diagram illustrating a relation between illuminance and correctness percentage for contrast sensitivity obtained by a verification experiment, and four types of spatial frequencies.

Next, in FIG. 12, the inventors performed a subjective evaluation of readability of letters with respect to contrast sensitivity of subjects and illuminance.

Part (a) in FIG. 12 is a graph illustrating a relation between illuminance and correctness percentage for contrast sensitivity obtained by a verification experiment. Part (b) in FIG. 12 is a diagram illustrating four types of spatial frequencies.

There were a total of 16 subjects in the middle age and old age. In this verification experiment, the correlated color temperature of light was set at 6000 K, and the correctness percentages of the subjects were tested with illuminance in a range of 300 lx to 1000 lx, inclusive. Here, the normal illuminance in the first mode was set to 500 lx, and illuminance in the second mode is set to an illuminance higher than 500 lx.

The contrast sensitivity was obtained by the verification experiment of the subjects. In the contrast sensitivity verification experiment, the correctness percentages for spatial frequencies 3 cpd, 6 cpd, 12 cpd, and 18 cpd were tested. Spatial frequency represents the number of striped patterns visible in a range of an angular unit of the angle of view (1 degree of the angle of view). For example, 3 cpd means that in a range of 1 degree of the angle of view, 3 pairs of a white line and black line can be seen.

Here, as illustrated in (a) and (b) in FIG. 12, the correctness percentage for each of illuminances 300 lx, 500 lx, 600 lx, 750 lx, and 1000 lx was the result of averaging the correctness percentages of spatial frequencies 3 cpd, 6 cpd, 12 cpd, and 18 cpd for the illuminance. For example, in the case of 300 lx illuminance, the correctness percentage for five items for which correctness is tested is obtained for the spatial frequency of 3 cpd. The correctness percentages are obtained in the same manner for the rest of the spatial frequencies, 6 cpd, 12 cpd, and 18 cpd, and the correctness percentage for the illuminance (300 lx) is calculated as the average value of the correctness percentages of the four spatial frequencies. This illuminance correctness percentage was also calculated for the rest of the illuminances (500 lx, 600 lx, 750 lx, and 1000 lx).

It can be seen that, although the correctness percentage rose together with the increase in illuminance when illuminance was 300 lx, 500 lx, 600 lx, and 750 lx, in the case where illuminance was 1000 lx, the correctness percentage did not change much from when illuminance was 750 lx.

Figure 13:
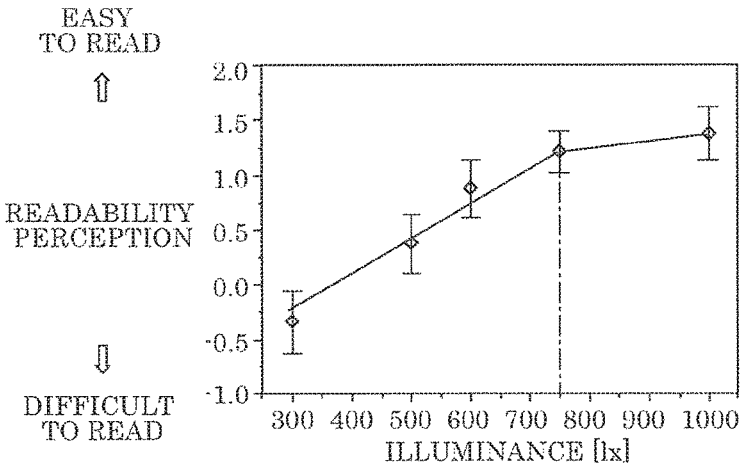
FIG. 13 is a graph illustrating subjective evaluation of readability of letters for illuminances, obtained by verification experiment.

FIG. 13 is a graph illustrating subjective evaluation of readability of letters for illuminances, obtained by verification experiment.

The readability of letters was obtained by subjective evaluation from the subjects. The subjective evaluation of readability was performed based on evaluation entries in seven stages in which "extremely easy to read" was assigned 3 points, "very easy to read" was assigned 2 points, "somewhat easy to read" was assigned 1 point "neutral" was assigned 0 point, "somewhat difficult to read" was assigned −1 point, "very difficult to read" was assigned −2 points, and "extremely difficult to read" was assigned −3 points. Then, the scores corresponding to these evaluation entries became the evaluation values.

As illustrated in FIG. 13, the evaluation of letter readability, for example, when illuminance was 300 lx was calculated by obtaining the evaluation values for the spatial frequencies 3 cpd, 6 cpd, 12 cpd, and 18 cpd, and obtaining the average value of the evaluation values obtained for the four spatial frequencies. Likewise, for each of the other the illuminances 500 lx, 600 lx, 750 lx, and 1000 lx, the evaluation value for letter readability was obtained from the average value obtained from the evaluation values of the four spatial frequencies.

It can be seen that, although the readability for the subjects rose together with the increase in illuminance among illuminances 300 lx, 500 lx, 600 lx, and 750 lx, in the case where illuminance was 1000 lx, the readability for the subjects did not change much from when illuminance was 750 lx. In other words, when illumination is too bright, power consumption for illumination only increases without much improvement in the readability for the subjects.

From these results, it can be seen that, when illuminance of 500 lx in the first mode is used as a basis, letter readability of illuminances from 500 lx to 750 lx improves. From the results obtained with this illuminance, letters become easy to read by setting the brightness of the second mode to at least 1.1 times and at most 1.5 times the brightness of the first mode.

Next, the inventors examined the contrast sensitivity regarding the number of correct answers by generation of subjects.

The subjects included 5 persons each for the twenties generation, thirties generation, forties generation, and sixties generation, and 10 persons for the fifties generation.

Figure 14:
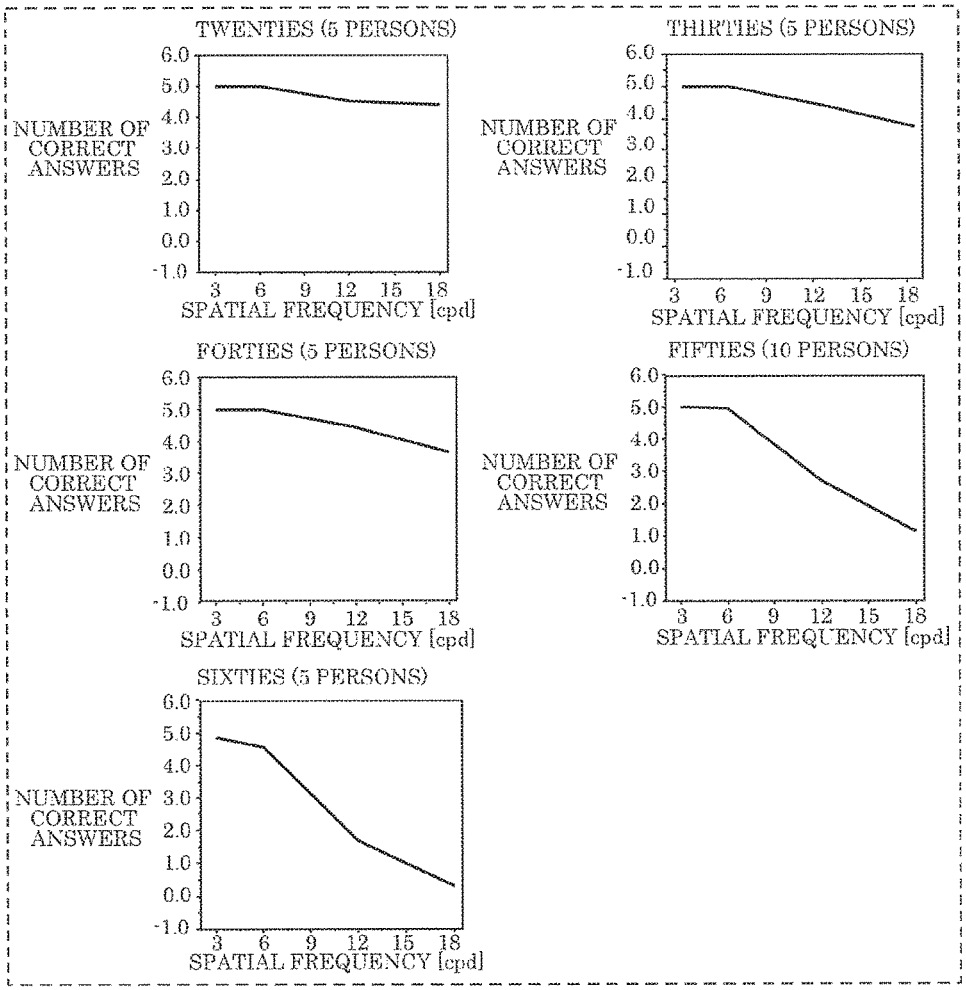
FIG. 14 shows graphs illustrating relations between spatial frequencies and number of correct answers by generation for contrast sensitivity obtained by a verification experiment.

FIG. 14 shows graphs illustrating relations between spatial frequencies and number of correct answers by generation for contrast sensitivity obtained by a verification experiment.

As illustrated in FIG. 14, it can be seen that with the subjects in the twenties generation, the number of correct answers did not decrease much even when the spatial frequency increased, whereas for the thirties generation and forties generation, the number of correct answers decreased with an increase in the spatial frequency. As for the fifties generation and sixties generation, it can be seen that the number of correct answers decreased significantly with the increase in spatial frequency.

Figure 15:
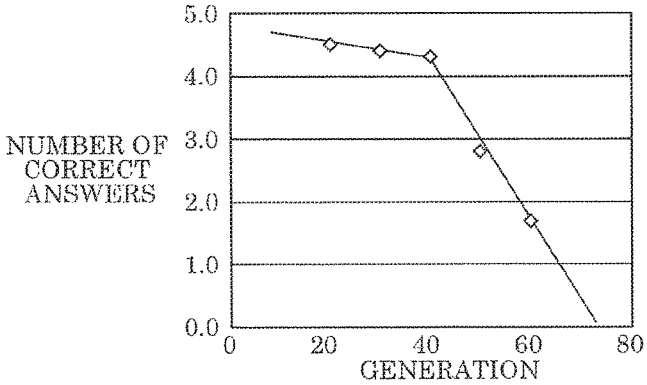
FIG. 15 is a graph illustrating a relation between generation and number of correct answers for contrast sensitivity obtained by a verification experiment.

FIG. 15 is a graph illustrating the relation between generation and number of correct answers for contrast sensitivity obtained by a verification experiment. FIG. 15 is a graph which averages the number of correct answers by generation from the results in FIG. 14.

From FIG. 15, it can be seen that the number of correct answers decreased more significantly for the fifties generation and sixties generation than in the other generations. This is because the positive finding rate for cataracts including initial opacity for the fifties generation is said to be approximately 37% to 54%. As an example of cataracts, it is possible to infer that contrast sensitivity deterioration tends to occur in a high frequency region of the spatial frequencies.

In view of this, the inventors performed a verification experiment using lighting apparatus 10 having the first mode and the second mode.

Part (a) in FIG. 16 is a table illustrating optical characteristics in the first mode and the second mode in the verification experiment. Part (a) in FIG. 16 shows the experiment results using lighting apparatus 10 having a correlated color temperature of approximately 5000 K in the first mode and approximately 6200 K in the second mode.

Part (b) in FIG. 16 is a graph illustrating spectral distributions of combined light in the first mode and the second mode in (a) in FIG. 16. Part (c) in FIG. 16 is a graph illustrating correctness percentages of subjects for the spectral distributions in the first mode and the second mode.

For the subjects, there were a total of 53 persons consisting of 30 males and 23 females in the middle and the old age from 60 years to 69 years. In this verification experiment, the results for the correctness percentages for middle aged and old aged subjects was obtained using red color paper and green color paper, with a chroma difference of 0.5 between the respective color papers. From the results, a result was obtained in which correctness percentages for the red and green color papers were significantly higher in the second mode than the first mode. From these results, it can be determined that in the second mode, which is one example of this embodiment, correctness percentages increased as a result of being able to see the color paper vividly.

Next, the inventors performed a near vision test on subjects in the middle age and old age, and obtained the number of correct answers of the subjects. In FIG. 17, verification examination under the same conditions as in FIG. 16 is performed, and thus detailed description of the same conditions will be omitted.

Part (a) in FIG. 17 is a graph illustrating correctness percentages for the first mode and the second mode at near vision level 0.5 in a near vision chart, obtained by verification experiment. Part (b) in FIG. 17 is a diagram illustrating a near vision chart (contrast 6%) used in the verification experiment. Part (c) in FIG. 17 is a diagram illustrating a formula for calculating the correctness percentage at each vision level. In (a) in FIG. 17, a result is obtained in which correctness percentage is significantly high at vision level 0.5 for the first mode. This vision level of 0.4 to 0.5 indicates vision capable of reading the letters in a newspaper, and if a letter size for vision level 0.5 is easy to read, it can be determined that letters in newspapers and books are easy to read.

According to the foregoing, it can be seen that, compared to the first mode, color is easier to see and letters are easier to read for middle aged and old aged subjects in the second mode.

[Effect]

Next, the effects of lighting apparatus 10 in this embodiment will be described.

As described above, lighting apparatus 10 according to this embodiment includes: first light emitting elements 51; second light emitting elements 52 having chromaticity values in the same chromaticity range as first light emitting elements 51; and control circuit 12 including mode switch 14 for controlling first light emitting elements 51 and second light emitting elements 52 separately. Furthermore, first light emitting elements 51 emit light having a spectral distribution that includes a first peak wavelength in a range of 425 nm to 480 nm inclusive and a second peak wavelength in a range of 500 nm to 560 nm inclusive. In addition, second light emitting elements 52 emit light having a spectral distribution that includes a first peak wavelength in a range of 425 nm to 480 nm inclusive, a second peak wavelength in a range of 500 nm to 560 nm inclusive, and a third peak wavelength in a range of 580 nm to 650 nm inclusive. Furthermore, in a spectral distribution of combined light which is a combination of the light emitted by first light emitting elements 51 and the light emitted by second light emitting elements 52, a ratio of a greatest value in a range of 500 nm to 560 nm inclusive to a smallest value in a range of 500 nm to 650 nm inclusive is 0.85 or lower, Moreover, control circuit 12 selectively executes a first mode for causing first light emitting elements 51 to emit light and a second mode which causes first light emitting elements 51 and second light emitting elements 52 to emit light. In addition, mode switch 14 switches between the first mode and the second mode.

In this manner, in the spectral distribution of combined light which is a combination of the light emitted by first light emitting elements 51 and second light emitting elements 52, the ratio of the greatest value in a range of 500 nm to 560 nm inclusive to the smallest value in a range of 500 nm to 650 nm inclusive is 0.85 or lower, and thus color perception percentage for old aged people can be increased. Furthermore, by using the two types of light emitting elements, first light emitting elements 51 and second light emitting elements 52, which have different spectral distributions, and switching between the first mode and the second mode, illumination suited to old aged people can be performed. As such, it is possible to prevent letters and observed objects from appearing to have lower color saturation to old aged people.

Therefore, letters and observed objects can be prevented from appearing to have lower color saturation to old aged people.

Furthermore, in lighting apparatus 10 according to this embodiment, the combined light has a correlated color temperature of at least 5500 K and at most 7100 K.

In this manner, since the correlated color temperature of combined light is at least 5700 K and at most 7100 K, it is possible to more reliably prevent letters and observed objects from appearing to have lower color saturation to old aged people.

Furthermore, lighting apparatus 10 according to this embodiment further includes third light emitting elements 53 that emit light having a correlated color temperature of at least 2600 K and at most 5500 K.

In this manner, since the correlated color temperature of the combined light of the light emitted by first light emitting elements 51 and second light emitting elements 52 is at least 5500 K and at most 7100 K, and third light emitting elements 53 having a correlated color temperature of at least 2600 K and at most 5500 K are further provided, the color adjustment range of lighting apparatus 10 becomes broad. Accordingly, with lighting apparatus 10, color adjustment from electric lamp color to daylight color can be realized.

Furthermore, in lighting apparatus 10 according to this embodiment, first light emitting elements 51 emit brighter light when emitting light in the first mode than when emitting light in the second mode.

In this manner, since it is brighter when first light emitting elements 51 emit light in the first mode than when first light emitting elements 51 emit light in the second mode, changing light emission efficiency and color rendering property by switching modes makes it possible to more reliably prevent letters and observed objects from appearing to have lower color saturation to old aged people.

Furthermore, in lighting apparatus 10 according to this embodiment, light emitted by lighting apparatus 10 in the second mode has a brightness that is at least 1.1 times to at most 1.5 times a brightness of light emitted by lighting apparatus 10 in the first mode.

In this manner, since the brightness of lighting apparatus 10 in the second mode is at least 1.1 times and at most 1.5 times the brightness of lighting apparatus 10 in the first mode, it is possible to improve readability of letters with respect to contrast sensitivity of old aged people and illuminance.

Furthermore, in lighting apparatus 10 according to this embodiment, light emitted by lighting apparatus 10 in the second mode has a general color rendering index Ra of at least 86 and at most 100.

In this manner, since the general color rendering index Ra of light emitted by lighting apparatus 10 is at least 86 and at most 100, it is possible to emit light having good color rendering property, and thus color can be faithfully reproduced. As such, it is possible to correctly show the color of objects to old aged people.

In particular, since color rendering property becomes better if the general color rendering index Ra of light is 90 or more, it is possible to more correctly show the color of objects to old aged people.

Furthermore, in lighting apparatus 10 according to this embodiment, light emitted by lighting apparatus 10 in the second mode has a feeling of contrast index (FCI) of at least 93 and at most 120.

In this manner, since the index for distinctness FCI of light emitted by lighting apparatus 10 in the second mode is at least 93 and at most 120, it is possible to secure the brightness perceived by old aged people based on color appearance.

Furthermore, in lighting apparatus 10 according to this embodiment, light emitted by lighting apparatus 10 in the second mode has a chroma value of 2.0 or less. Here, the chroma value is calculated using a calculation method stipulated by CIE 1997 Interim Color Appearance Model (Simple Version).

In this manner, since the chroma value of light emitted by lighting apparatus 10 in the second mode is 2.0 or lower, whitishness increases, and thus readability of letters improves.

Furthermore, lighting apparatus 10 according to this embodiment further includes setter 13 that sets the age or the generation of a user. In addition, control circuit 12 increases an amount of light emitted by second light emitting elements 52 in proportion to the age or generation of the user set by setter 13.

In this manner, since the amount of light emission of second light emitting elements 52 is increased in proportion to the age or generation of the user, the readability of letters can be enhanced and the correct color of objects can be more correctly shown, as age and generation increases.

Furthermore, in lighting apparatus 10 according to this embodiment, second light emitting elements 52 and third light emitting elements 53 emit brighter light when emitting light in the second mode than when emitting light in the first mode.

Furthermore, in lighting apparatus 10 according to this embodiment, the percentage of second light emitting elements 52 among first light emitting elements 51 and second light emitting elements 51 satisfies at least a 2 to 1 ratio in number of first light emitting elements 51 to second light emitting elements 52.

Other Embodiments

Although an exemplary embodiment has been described thus far, the present disclosure is not limited to the foregoing embodiment.

For example, in the foregoing embodiment, in order to achieve age or generation-dependent appropriate amounts of light emitted by the first light emitting elements and the second light emitting elements, the control circuit may store in advance values of current which flow through the first light emitting elements and the second light emitting elements to achieve the appropriate amounts of light corresponding to the age or generation. For example, upon the input of the other external signal, the control circuit obtains an age from the external signal, and reads a value of current which flows through the first light emitting elements for the age or generation and a value of current which flows through the second light emitting elements for the age or generation. By controlling the constant-power output circuit based on the read values of current, the control circuit causes the first light emitting elements and the second light emitting elements to emit light at the amount of light emission for the input age or generation. Accordingly, the first light emitting elements and the second light emitting elements can be caused to emit light at an amount of light emission corresponding to an age or generation, and thus a constant color perception percentage can be secured for any age.

Although one or more aspects of the present disclosure has been described based on the foregoing embodiment, the present disclosure is not limited to the foregoing embodiment. Forms obtained by various modifications to the exemplary embodiment that can be conceived by a person of skill in the art as well as forms realized by combining structural components of different exemplary embodiments, which are within the scope of the essence of the present invention may be included in the scope of the one or more aspects of the disclosure.

What is claimed is:

1. A lighting apparatus, comprising:

first light emitting elements;

second light emitting elements having chromaticity values in a same chromaticity range as the first light emitting elements; and a control circuit including a mode switch for controlling the first light emitting elements and the second light emitting elements separately, wherein the first light emitting elements emit light having a spectral distribution that includes a first peak wavelength in a range of 425 nm to 480 nm inclusive and a second peak wavelength in a range of 500 nm to 560 nm inclusive, the second light emitting elements emit light having a spectral distribution that includes a first peak wavelength in a range of 425 nm to 480 nm inclusive, a second peak wavelength in a range of 500 nm to 560 nm inclusive, and a third peak wavelength in a range of 580 nm to 650 nm inclusive, in a spectral distribution of combined light which is a combination of the light emitted by the first light emitting elements and the light emitted by the second light emitting elements, a ratio of a greatest value in a range of 500 nm to 560 nm inclusive to a smallest value in a range of 500 nm to 650 nm inclusive is 0.85 or lower, the control circuit selectively executes a first mode for causing the first light emitting elements to emit light and a second mode for causing the first light emitting elements and the second light emitting elements to emit light, and the mode switch switches between the first mode and the second mode.

2. The lighting apparatus according to claim 1, wherein the combined light has a correlated color temperature of at least 5500 K and at most 7100 K.

3. The lighting apparatus according to claim 2, further comprising:

third light emitting elements that emit light having a correlated color temperature of at least 2600 K and at most 5500 K.

4. The lighting apparatus according to claim 3, wherein the second light emitting elements and the third light emitting elements emit brighter light when emitting light in the second mode than when emitting light in the first mode.

5. The lighting apparatus according to claim 1, wherein the first light emitting elements emit brighter light when emitting light in the first mode than when emitting light in the second mode.

6. The lighting apparatus according to claim 1, wherein light emitted by the lighting apparatus in the second mode has a brightness that is at least 1.1 times to at most 1.5 times a brightness of light emitted by the lighting apparatus in the first mode.

7. The lighting apparatus according to claim 1, wherein light emitted by the lighting apparatus in the second mode has a general color rendering index of at least 86 and at most 100.

8. The lighting apparatus according to claim 1, wherein light emitted by the lighting apparatus in the second mode has a feeling of contrast index (FCI) of at least 93 and at most 120.

9. The lighting apparatus according to claim 1, wherein light emitted by the lighting apparatus in the second mode has a chroma value of 2.0 or less, the chroma value being calculated using a calculation method stipulated by CIE 1997 Interim Color Appearance Model (Simple Version).

10. The lighting apparatus according to claim 1, further comprising:

a setter that sets an age or a generation of a user, wherein the control circuit increases an amount of light emitted by the second light emitting elements in proportion to the age or the generation of the user set by the setter.

11. The lighting apparatus according to claim 1, wherein a percentage of the second light emitting elements among the first light emitting elements and the second light emitting elements satisfies at least a 2 to 1 ratio in number of the first light emitting elements to the second light emitting elements.

* * * * *